US006877571B2

(12) United States Patent
Hughes et al.

(10) Patent No.: US 6,877,571 B2
(45) Date of Patent: Apr. 12, 2005

(54) DOWN HOLE DRILLING ASSEMBLY WITH INDEPENDENT JET PUMP

(75) Inventors: William James Hughes, Tulsa, OK (US); Jimmie Josh Renfro, Plano, TX (US)

(73) Assignee: Sunstone Corporation, Oklahoma City, OK (US)

( * ) Notice: Subject to any disclaimer, the term of this patent is extended or adjusted under 35 U.S.C. 154(b) by 274 days.

(21) Appl. No.: 09/946,849

(22) Filed: Sep. 4, 2001

(65) Prior Publication Data

US 2003/0042048 A1 Mar. 6, 2003

(51) Int. Cl.[7] ..... E21B 7/00; E21B 10/60

(52) U.S. Cl. ..... 175/57; 175/393; 175/324; 175/340

(58) Field of Search ..... 175/57, 393, 340, 175/337, 339, 65, 324, 213, 217, 212

(56) References Cited

U.S. PATENT DOCUMENTS

| | | | | | |
|---|---|---|---|---|---|
| 270,488 | A | * | 1/1883 | Saunders | 175/213 |
| 2,201,270 | A | * | 5/1940 | McIntyre | 175/209 |
| 2,234,454 | A | | 3/1941 | Richter | 255/24 |
| 2,849,214 | A | * | 8/1958 | Hall | 175/324 |
| 2,946,565 | A | | 7/1960 | Williams | 255/1.8 |
| 3,087,558 | A | | 4/1963 | Dougherty | 175/65 |
| 3,208,539 | A | | 9/1965 | Henderson | 175/215 |
| 3,924,696 | A | * | 12/1975 | Horlin et al. | 175/209 |
| 3,948,330 | A | | 4/1976 | Langford, Jr. | 175/339 |
| 4,022,285 | A | | 5/1977 | Frank | 175/340 |
| 4,239,087 | A | | 12/1980 | Castel | 175/65 |
| 4,436,166 | A | | 3/1984 | Hayatdavoudi | 175/65 |
| 4,534,426 | A | | 8/1985 | Hooper | 175/65 |
| 4,567,954 | A | * | 2/1986 | Voight et al. | 175/424 |
| 4,630,691 | A | * | 12/1986 | Hooper | 175/65 |
| 4,687,066 | A | | 8/1987 | Evans | 175/340 |
| 4,744,730 | A | | 5/1988 | Roeder | 417/54 |
| 5,355,967 | A | | 10/1994 | Mueller et al. | 175/65 |
| 5,456,326 | A | | 10/1995 | Raines | 175/57 |
| 5,562,171 | A | | 10/1996 | Besson et al. | 175/339 |
| 5,771,984 | A | | 6/1998 | Potter | 175/14 |
| 5,775,443 | A | | 7/1998 | Lott | 175/57 |
| 5,836,404 | A | | 11/1998 | Trujillo | 175/57 |
| 5,921,476 | A | | 7/1999 | Akin | 239/590 |
| 5,992,763 | A | | 11/1999 | Smith | 239/428.5 |
| 6,129,152 | A | | 10/2000 | Hosie et al. | 166/384 |
| 6,209,663 | B1 | | 4/2001 | Hosie | 175/57 |
| 6,276,455 | B1 | | 8/2001 | Gonzalez | 166/357 |
| 2002/0170749 | A1 | * | 11/2002 | Hoyer et al. | 175/25 |

FOREIGN PATENT DOCUMENTS

| | | |
|---|---|---|
| EP | 1 288 434 | 5/2003 |

* cited by examiner

*Primary Examiner*—Kenn Thompson
(74) *Attorney, Agent, or Firm*—Rudolf O. Siegesmund

(57) ABSTRACT

A Down Hole Drilling Assembly (DHDA) that induces artificial lift to remove the drilling fluid from a well bore using a jet pump attached to a casing string. The DHDA includes a drill string that passes through the jet pump assembly. The power fluid is separated from the drilling fluid until after it has passed through the nozzle of the jet pump. The jet pump assembly is joined to a concentric casing string. The jet pump also contains a bladder element that expands to redirect the flow of the drilling fluid from the inner annulus into the jet pump assembly. The jet pump assembly lifts the drilling fluid, lowering the fluid level within a well bore to a point where the hydrostatic pressure near the bottom of the well is lower than the pore pressure of the formation being drilled thereby creating under balanced conditions.

49 Claims, 8 Drawing Sheets

*Fig. 4*
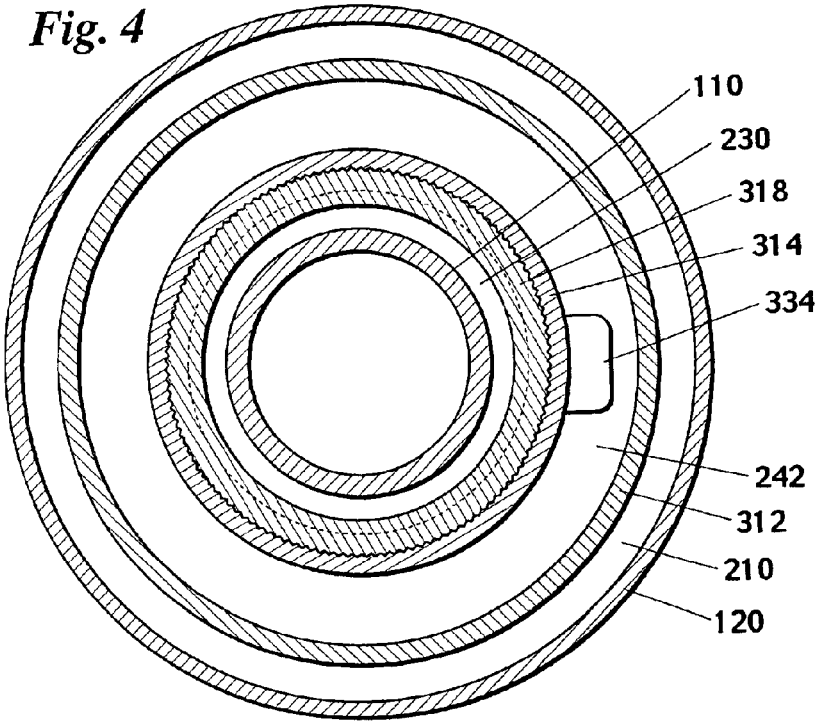
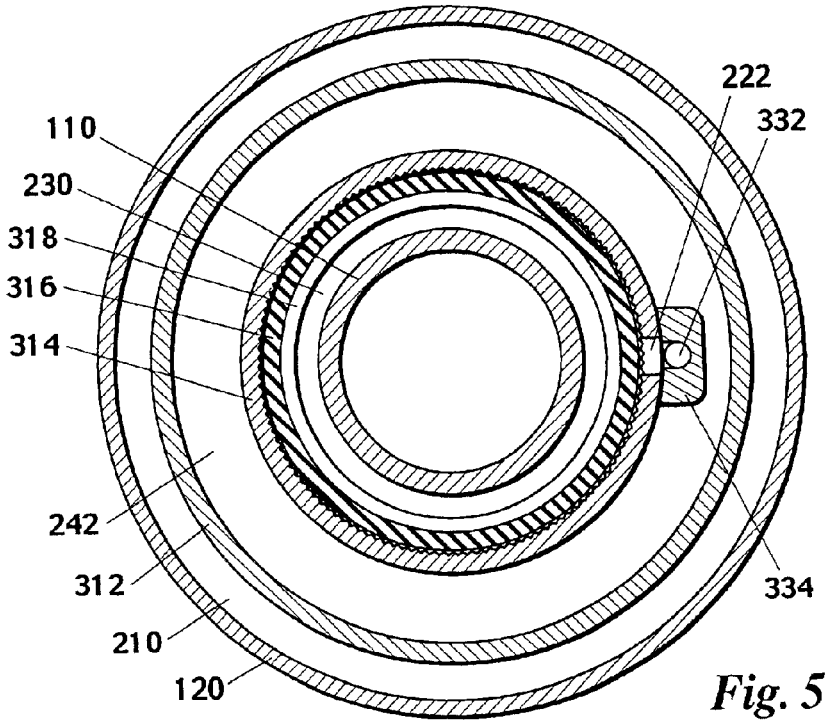
*Fig. 5*

DOWN HOLE DRILLING ASSEMBLY WITH INDEPENDENT JET PUMP

FIELD OF INVENTION

The present invention relates to oilfield drilling devices and methods, and specifically, to an apparatus and method for inducing under balanced drilling conditions by artificially lifting the drilling fluid and the formation fluid with a jet pump assembly affixed to an inner casing section while simultaneously drilling with a drill bit and drill pipe that passes through the jet pump assembly.

BACKGROUND

In order to produce fluids such as oil, gas, and water from subterranean rock formations, a well is drilled into the fluid-bearing zone. Most wells are generally drilled with a drilling rig, a drill bit, a drill pipe, and a pump for circulating fluid into and out of the hole that is being drilled. The drilling rig rotates and lowers the drill pipe and drill bit to penetrate the rock. Drilling fluid, sometimes referred to as drilling mud, is pumped down the drill pipe through the drill bit to cool and lubricate the action of the drill bit as it disaggregates the rock. In addition, the drilling fluid removes particles of rock, known as cuttings, generated by the rotational action of the drill bit. The cuttings become entrained in the column of drilling fluid as it returns to the surface for separation and reuse. The column of drilling fluid also serves a second purpose by providing weight to prevent seepage from the formation into the well. When the weight of the column of drilling fluid is used to prevent seepage, the hydrostatic pressure of the column of drilling fluid exceeds the pressure contained within the formation, a drilling condition referred to as over balanced drilling.

A desired condition when drilling is to prevent drilling fluids from penetrating the surrounding rock and contaminating the reservoir. Another desired condition is to allow any fluid such as oil from the reservoir being drilled to flow into the well bore above the drill bit so that production can be obtained during the drilling process. Both of these conditions can be achieved by lowering the bottom hole pressure, or in other words, lowering the hydrostatic pressure that is exerted by the column of fluids in a well bore to a point that is below the pore pressure which exists within a rock formation. Lowering the bottom hole pressure within a well bore while drilling below the formation pressure to accomplish either of these goals is called under balanced drilling.

Conventional under balanced drilling intentionally reduces the density of fluids contained in the well bore. In conventional under balanced drilling, the reduction in the density of the fluids causes the hydrostatic pressure of the fluid column to be lower than the pressure contained within the pores of the rock formation being drilled. When a reduction in density causes the hydrostatic pressure of the fluid column to be lower than the pressures contained within the pores of the rock formation being drilled, fluids in the reservoir may flow into the well bore while it is being drilled. Under balanced drilling has gained popularity in the upstream oil and gas industry because it does not allow the drilling fluids to penetrate the surrounding rock and damage the permeability of the reservoir.

The under balanced condition is usually achieved by injecting a density reducing agent such as air, nitrogen, exhaust, or natural gas into the fluids that are being pumped down the drill pipe during the process of drilling a well. The injected gas combines with the drilling fluid and reduces its density and thus lowers the hydrostatic pressure that exists in the annulus between the drill pipe and the wall of the well bore. The concentric casing technique is a common method for delivering the gas to the bottom of the well by utilizing a second string of casing hung in the well bore inside the production casing. The injected gas flows down to the bottom of the well through the outer annulus created by the two strings of casings. The drilling fluid, delivered via the drill pipe, and any produced fluid combine with the injected gas as it flows upwards through the inner annulus between the second or concentric string of casing and the drill pipe. The process may be reversed such that the inner annulus is used for injection and the outer annulus is used for well effluent. The use of gas as a density reducing agent has distinct disadvantages. First, if air is used, the risk of down hole fires and corrosion problems are invited. Second, if an inert gas such as nitrogen is used, the expense may be prohibitive. In either case, the cost of compression that is required by all types of gas at the surface is significant.

Another method for lowering bottom hole pressure is by artificially inducing lift to remove fluids from a well by using a jet pump and a power fluid. The use of jet pumps is common in production operations where drilling activity has stopped. In this case, the drill pipe and drill bit have been extracted and a jet pump is lowered into the well on the end of a tubing string. A surface pump delivers high-pressure power fluid down the tubing and through the nozzle, throat, and diffuser of the jet pump. The pressure of the power fluid is converted into kinetic energy by the nozzle, which produces a very high velocity jet of fluid. The drilling and production fluids are drawn into the throat of the jet pump by the stream of high velocity power fluid flowing from the nozzle into the throat of the jet pump. The drilling and production fluids mix with the power fluid as they pass through the diffuser. As the fluids mix, the diffuser converts the high velocity mixed fluid back into a pressurized fluid. The pressured fluids have sufficient energy to flow to the surface through the annulus between the production casing and the tubing that carried the jet pump into the well.

While jet pumps are used for removing fluid from a well by lowering down hole pressure in production wells, the advantages of under-balanced drilling would be enhanced significantly if a jet pump could be combined with drilling operations. The jet pump could be employed to achieve under-balanced conditions while the drill string is down in the hole and the drill bit is operating. By using a power fluid such as water, the disadvantages of gas could be avoided altogether thereby increasing safety and decreasing costs. Attempts have been made to place jet pumps into drill bits. However, when the jet pump is placed in the drill bit, the drilling fluid serves a dual purpose and becomes the power fluid before entering the nozzle of the jet pump. When the power fluid and the drilling fluid are one in the same and enter the nozzle of the jet pump, the extreme abrasiveness of the drilling fluid can cause the jet pump to wear out prematurely.

What is needed beyond the prior art is a jet pump connected to a concentric casing string that will induce artificial lift while allowing the drill bit to operate independently of the jet pump. What is further needed beyond the prior art is a jet pump connected to a concentric casing string that will keep the power fluid separate from the drilling fluid until after the power fluid has passed through the nozzle of the jet pump.

SUMMARY OF INVENTION

The invention that meets the needs identified above is a Down Hole Drilling Assembly (DHDA) for inducing artificial lift of the drilling and formation fluid by means of a hydraulic jet pump attached to a concentric casing string and a drill string including a drill bit and drill string that passes through the jet pump. In this design, the drilling fluid and production fluid do not mix with the power fluid until after the power fluid has passed through the nozzle of the jet pump. The jet pump is joined to an inner casing section of a concentric casing string. The jet pump consists of a nozzle, a throat, and a diffuser. The jet pump assembly also contains a bladder that inflates to redirect the flow of drilling fluid from the inner annulus to the throat of the jet pump.

BRIEF DESCRIPTION OF DRAWINGS

FIG. 4 is a cross-sectional view of the preferred embodiment of DHDA taken along line 4—4 in FIG. 1 showing the bladder elbow, bladder housing, drilling fluid chamber, inner annulus, outer annulus, and drill string.

FIG. 5 is a cross-sectional view of the preferred embodiment of DHDA taken along line 5—5 in FIG. 1 showing the bladder, bladder inlet, bladder elbow, bladder tube, inner annulus, outer annulus, and drill string.

DESCRIPTION OF PREFERRED EMBODIMENT

Figure 1:
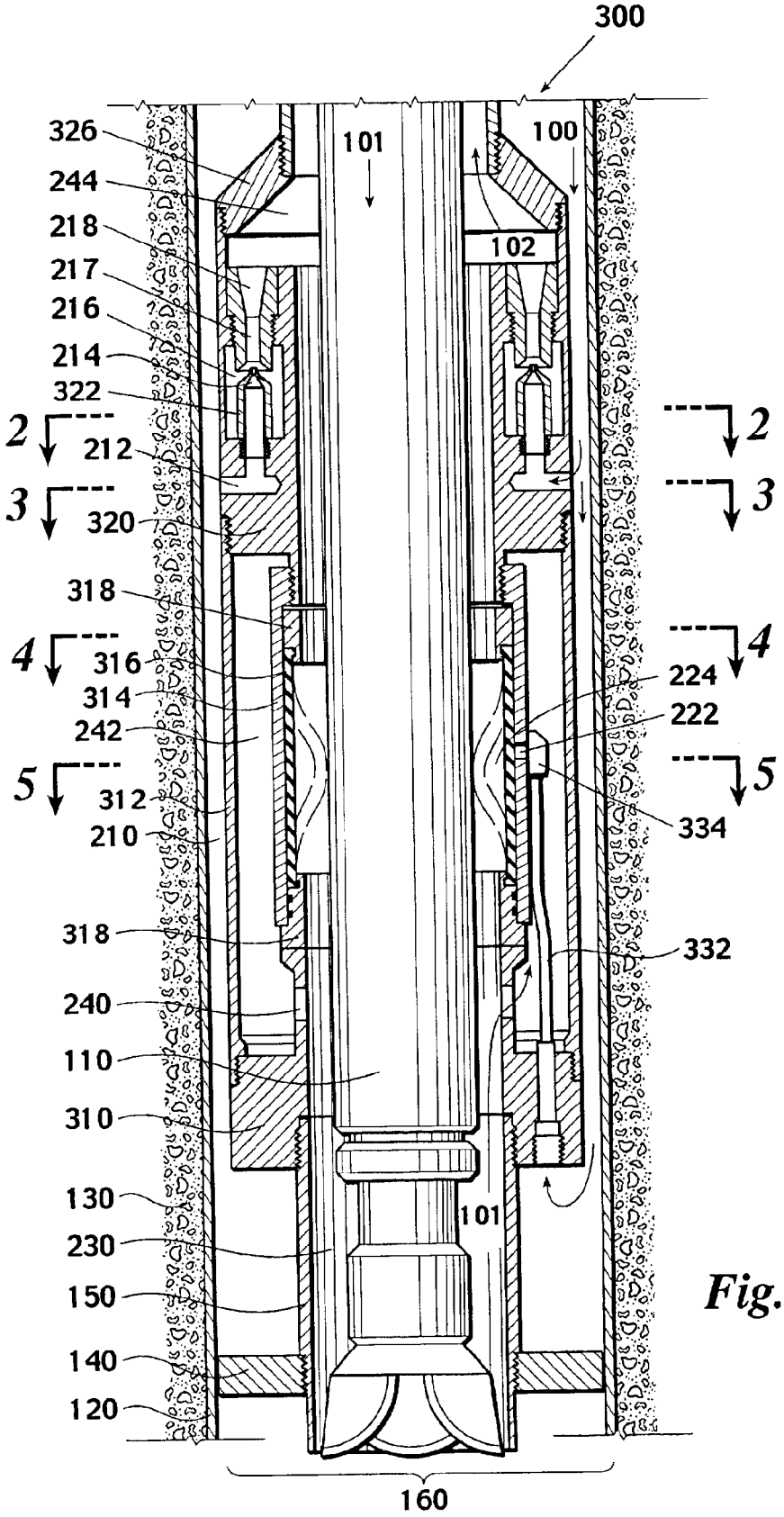
FIG. 1 is a view of the preferred embodiment of the CCJP and (DHDA) showing the un-inflated bladder. The inflated bladder position is indicated by the dashed line.

As seen in FIG. 1, well bore 160 is lined with production casing 120, which separates outer annulus 210 from earth 130. Packer 140 expands to fit production casing 120. Inner casing 150 is concentric with and has a smaller diameter than production casing 120. Inner casing 150 extends downwardly from the surface and is affixed to packer 140. Inner casing 150 and production casing 120 form outer annulus 210, which extends up to the surface and is closed at the bottom by packer 140. Outer annulus 210 contains power fluid 100, which is pressurized from the surface. Drill string 110 is inserted inside inner casing 150 and inner annulus 230 is created between drill string 110 and inner casing 150. Drilling fluid 101 flows from the surface through the middle of drill string 110 to the bottom of well bore 160 and then flows upwards through the annular region between drill string 110, and production casing 120. When drilling fluid 101 reaches packer 140, it flows up through inner annulus 230. The flow of drilling fluid 101 can be reversed between drill string 110 and inner annulus 230.

DHDA 300 is affixed to inner casing 150 and positioned above packer 140. As used herein, the term jet pump means an apparatus having a nozzle, a throat, and a diffuser which transfers energy from a power fluid to a drilling and production fluid to artificially lift and remove drilling and produced fluids from a well thereby decreasing the hydrostatic weight of the combined fluid column in the annulus between the concentric casing string and drill pipe above the jet pump. Drilling fluid inlet housing 310 screws onto and extends up and out from inner casing 150. Drilling fluid inlet housing 310 has approximately the same inside diameter as inner casing 150 so that drilling fluid 101 may continue to flow up to the surface through inner annulus 230 if desired. Drilling fluid inlet housing 310 also contains drilling fluid inlet 240, which is an aperture in drilling fluid inlet housing 310 that allows drilling fluid 101 to flow into drilling fluid chamber 242. Drilling fluid chamber 242 is an annular region that allows drilling fluid 101 to flow from drilling fluid inlet 240 to pump chamber 216.

As seen in FIG. 4, drilling fluid chamber 242 is defined on its outside by drilling fluid chamber outer wall 312, which screws onto and extends up from drilling fluid inlet housing 310. Drilling fluid chamber 242 is defined along its inside by bladder housing 318, drilling fluid chamber inner wall 314, and pump housing 320. Drilling fluid chamber inner wall 314 extends up along drilling fluid chamber 242 and is welded to bladder housing 318. Bladder housing 318 holds bladder 316 in place and consists of a pair of cylinders at the upper and lower end of bladder 316, which have the same outer diameter as the inside wall of drilling fluid chamber inner wall 314. As used herein, the term bladder means a device that inflates from a first position into a second position to make contact with a drill string and divert the return flow of fluids through the jet pump. The lower cylinder of bladder housing 318 is welded to drilling fluid inlet housing 310. The upper cylinder of bladder housing 318 is welded to the inside wall of drilling fluid chamber inner wall 314.

Bladder 316 is cylindrical and interlocks with bladder housing 318. Bladder 316 has the same outer diameter as the inside wall of drilling fluid chamber inner wall 314. Bladder 316 is made of an expansive material, such as rubber, that expands inwardly from drilling fluid chamber inner wall 314 to drill string 110 when inflated. Bladder tube 332 is screwed into drilling fluid inlet housing 310. Bladder tube 332 extends up through drilling fluid chamber 242 and is screwed into bladder elbow 334. Bladder elbow 334 is welded to drilling fluid chamber inner wall 314. As seen in FIGS. 1 and 5, bladder inlet 222 allows power fluid 100 to flow through drilling fluid chamber inner wall 314 between bladder elbow 334 and bladder 316. Power fluid 100 flows from outer annulus 210 through bladder tube 332, bladder elbow 334, and bladder inlet 222 to bladder 316. As the pressure of power fluid 100 increases, power fluid 100 will fill bladder fill zone 224 and bladder 316 will expand until it contacts drill string 110. When bladder 316 contacts drill string 110, bladder 316 diverts the flow of drilling fluid 101 within inner annulus 230 and forces drilling fluid 101 to flow through drilling fluid inlet 240 into drilling fluid chamber 242.

Figure 2:
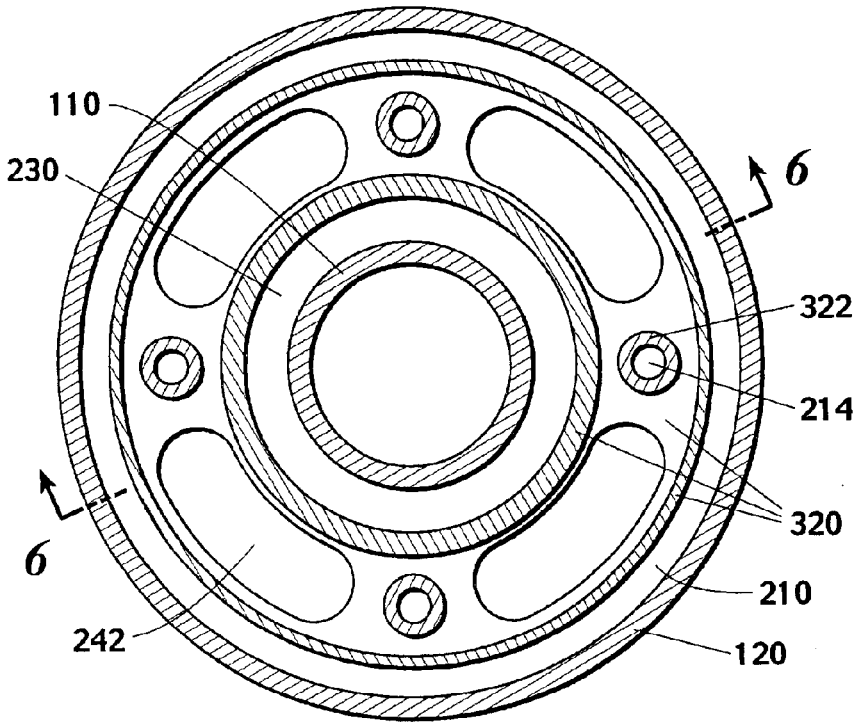
FIG. 2 is a cross-sectional view of the preferred embodiment of CCJP and (DHDA) taken along line 2—2 in FIG. 1 showing the jet pumps, drilling fluid chambers, inner annulus, and the outer annulus.
Figure 6:
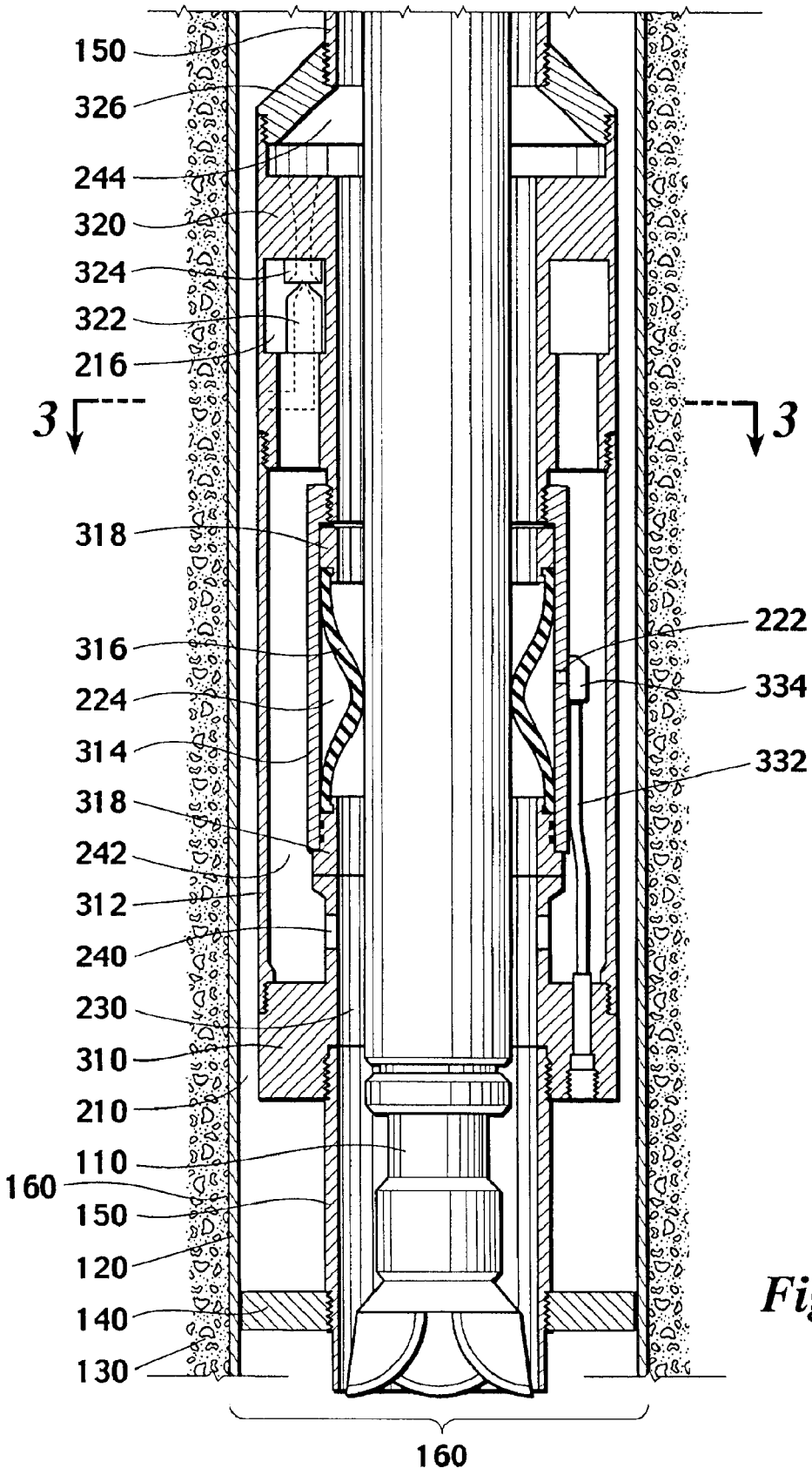
FIG. 6 is a view of the preferred embodiment of the DHDA taken along line 6—6 in FIG. 2 showing the inflated bladder and the extension of the drilling fluid chambers to the pump chamber.

As seen in FIG. 2, pump housing 320 screws onto both drilling fluid chamber inner wall 314 and drilling fluid chamber outer wall 312. Drilling fluid chamber 242 splits into four sections as it extends up through pump housing 320 as seen in FIG. 6. Drilling fluid 101 flows up through drilling fluid chamber 242 and enters pump chamber 216. Pump chamber 216 is an annular region defined on the inside by pump 322 and on the outside by pump housing 320. Drilling fluid 101 in pump chamber 216 surrounds pump 322 and is pulled into throat 217 by power fluid 100 exiting pump nozzle 214.

Figure 3:
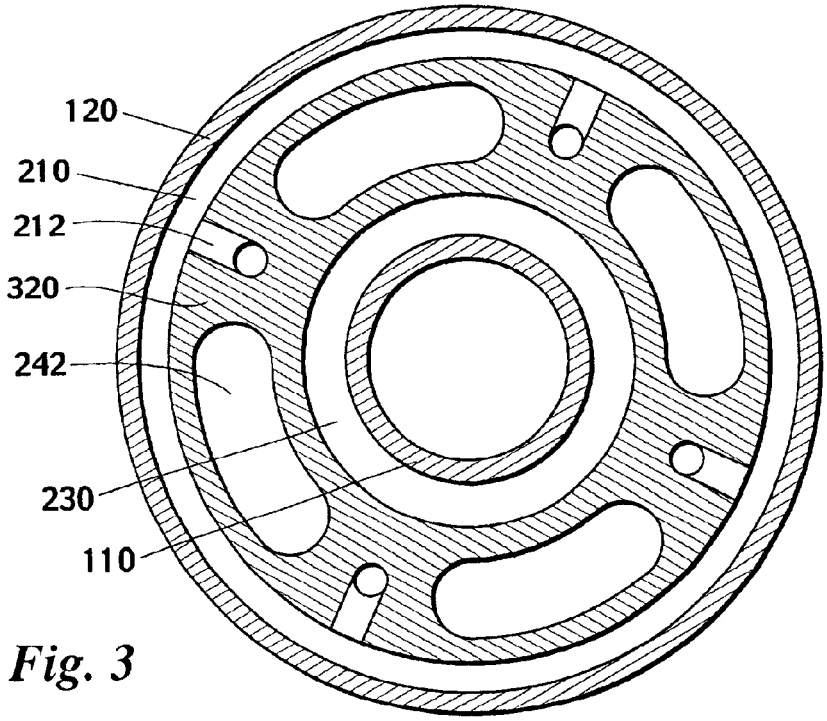
FIG. 3 is a cross-sectional view of the preferred embodiment of DHDA taken along line 3—3 in FIG. 1 showing the jet inlet, drilling fluid chambers, inner annulus, and the outer annulus.

As seen in FIG. 3, pump housing 320 contains four pump inlets 212 which allow power fluid 100 to flow from outer annulus 210 to pump 322. DHDA 300 contains four pumps 322, which screw into pump housing 320. Each pump 322 is cylindrical in shape and has pump nozzle 214 fixedly joined to the upper end of pump 322. Pump nozzle 214 is conical in shape, having an aperture at its apex to let power fluid 100 flow from pump 322 into throat 217.

Figure 9:
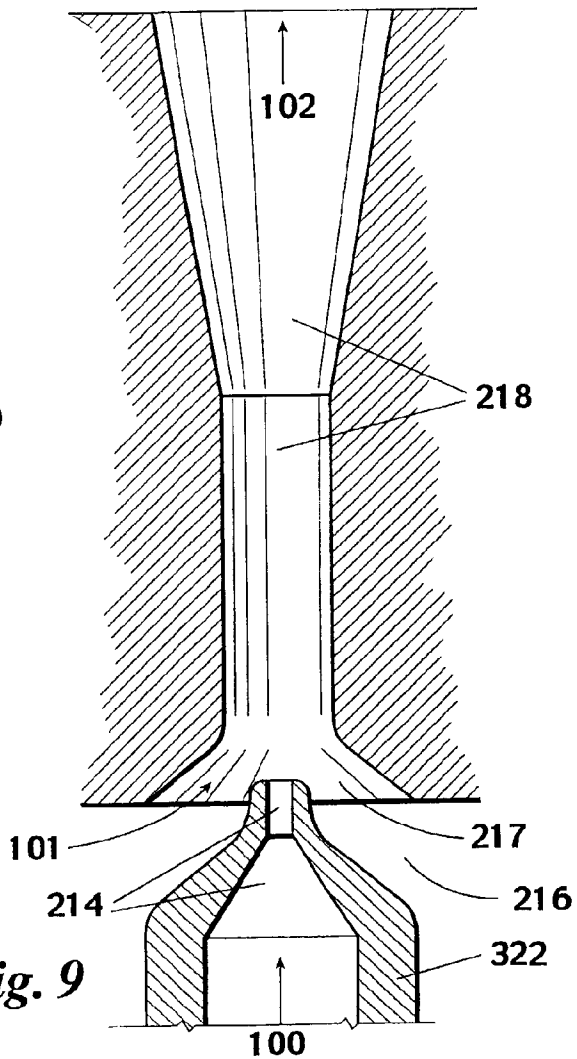
FIG. 9 is a detail view of the DHDA showing the jet pump, throat, and diffuser.

As seen in FIG. 9, power fluid 100 and drilling fluid 101 mix together in throat 217 to form effluent 102. Effluent 102 flows up through throat 217 and enters diffuser 218. Diffuser 218 is a conical aperture in diffuser housing 324 which screws into pump housing 320. Effluent 102 flows up from diffuser 218 and into effluent chamber 244. Effluent chamber 244 is an annular region defined on its outside by inner casing adapter 326 and on its inside by drill string 110. Inner casing adapter 326 screws onto pump housing 320 and inner casing 150. Effluent 102 flows up from effluent chamber 244 into inner annulus 230 and continues to the surface.

Figure 7:
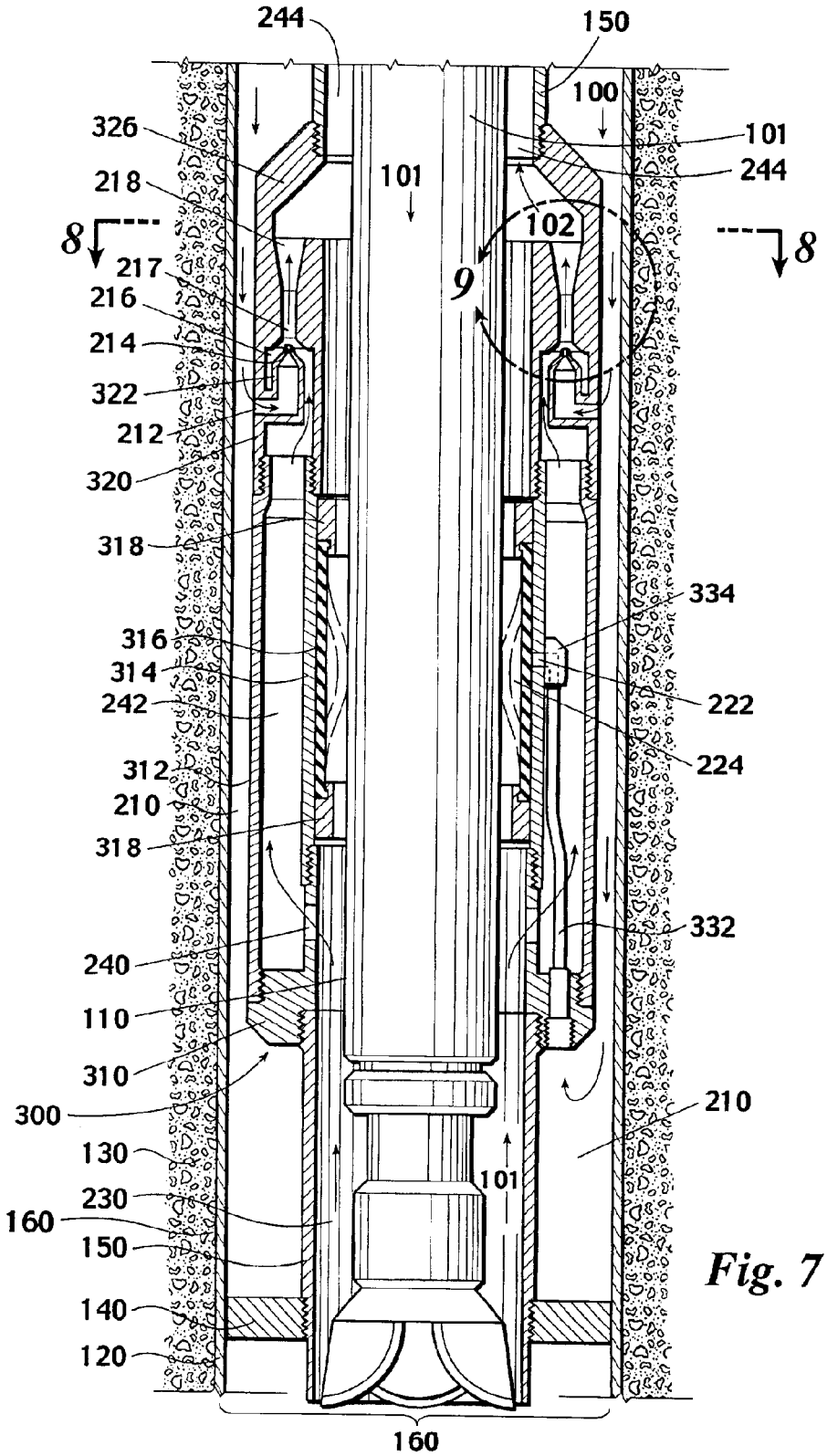
FIG. 7 is an alternative embodiment of the DHDA showing the unitary construction of the pumps and pump housing.
Figure 8:
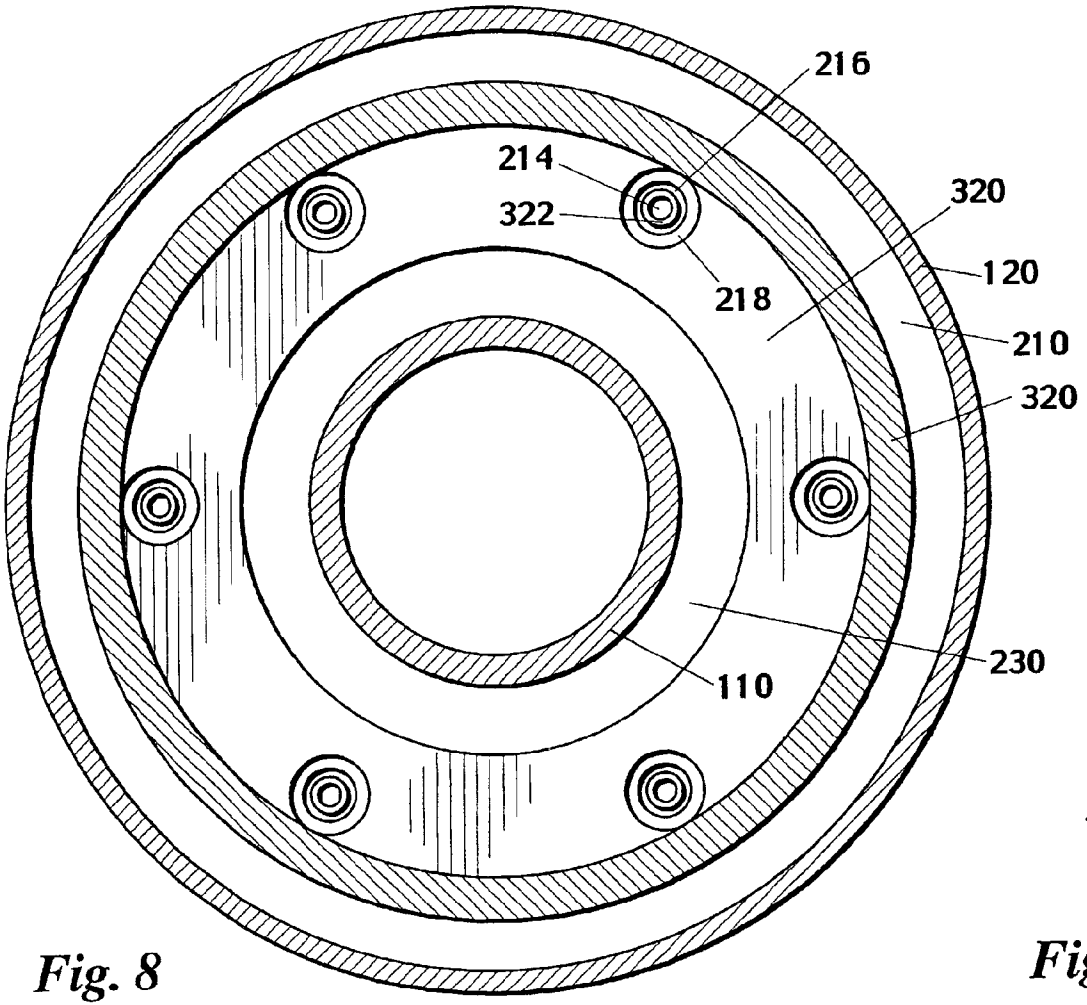
FIG. 8 is a cross-sectional view of the alternative embodiment of DHDA taken along line 8—8 in FIG. 7 showing the jet nozzle, diffuser, pump chamber, inner annulus, and outer annulus.
Figure 10:
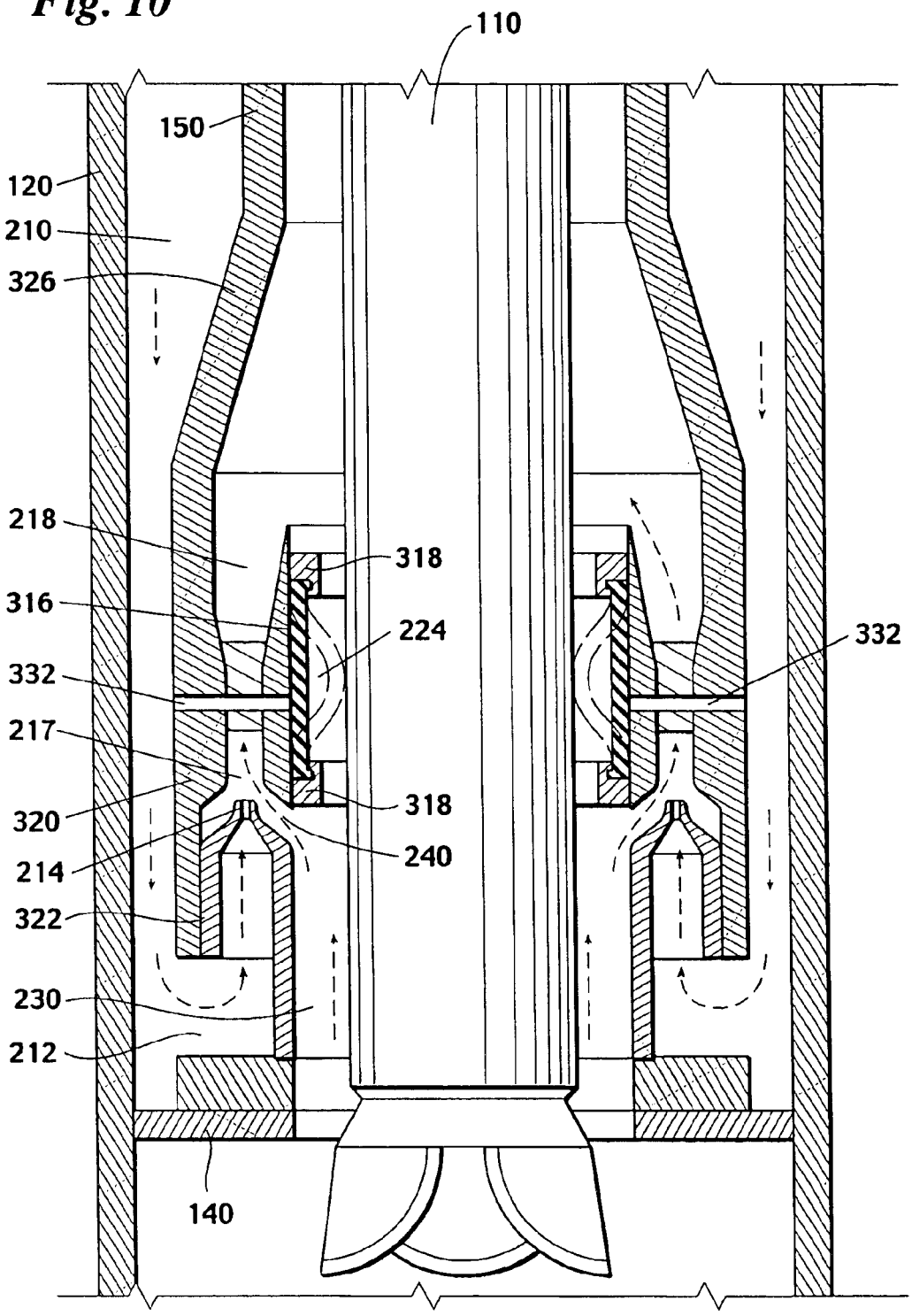
FIG. 10 is a cross section of an alternative embodiment of CCJP DHDA in which the drilling fluid chamber inside wall and drilling fluid chamber outside wall act as the diffuser.

CCJP and (DHDA) 300 operates as described only when bladder 316 is inflated as indicated in FIG. 6. When bladder 316 is not inflated, drilling fluid 101 will flow up through inner annulus 230 instead of into drilling fluid inlet 240. When the pressure of power fluid 100 is increased to expand bladder 316 to fit against drill string 110, drilling fluid 101 will no longer be allowed to flow up through inner annulus 230, and will instead be forced into drilling fluid inlet 240. As seen in FIG. 10, an alternate embodiment of DHDA 300 is shown where bladder tube 332 extends up and pump 322 is combined with drilling fluid inlet 240. The alternate embodiment in FIG. 10 is advantageous because of the reduction in the number of parts required. Further alternative embodiments are also possible by forming parts of DHDA 300 with unitary construction. In FIG. 7, jet pump 322 and pump housing 320 are unitary. Moreover, the number of jet pumps should not be limited to number depicted in the preferred embodiment. FIG. 8 is an alternative embodiment of DHDA 300 which utilizes six jet pumps. FIG. 8 is also a view of the top of the jet pump looking down the diffuser showing the jet pump nozzle, throat, and diffuser.

The method of inducing lift to remove drilling and production fluid 101 involves injecting power fluid 100 through a nozzle so that when the power fluid exits the nozzle a pressure differential is created that draws in drilling and production fluid 101. The power fluid enters the diffuser where the power fluid combines with the drilling fluid and the production fluid. When the power fluid combines with the drilling fluid and the production fluid, the high velocity power fluid converts the drilling fluid and production fluid to a combined pressurized fluid that now has the energy to flow to the surface. This process reduces the pressure of effluent 102, by reducing the hydrostatic weight of the fluid column above DHDA 300. The reduction in the hydrostatic weight in turn reduces the pressure in well bore 160 below DHDA 300 and allows the production fluid in the reservoir to flow into well bore 160. This method of inducing lift can be utilized during the drilling process and is attached to inner casing 150 rather than drill string 110.

Figure 11:
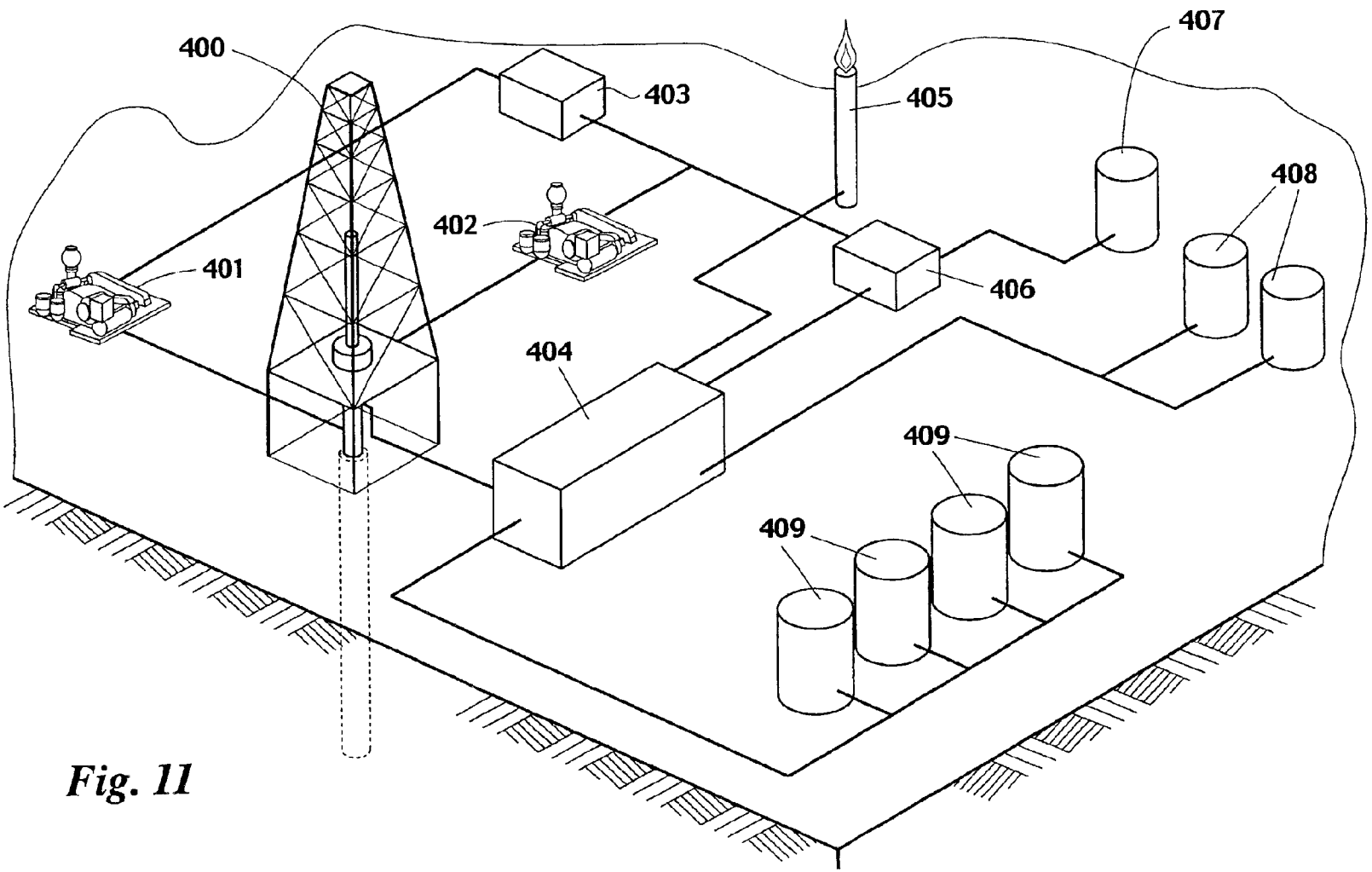
FIG. 11 is a depiction of the surface equipment used to operate the DHDA.

FIG. 11 displays the surface equipment that is needed to drill an under balanced well using the concentric jet pump. Some of the equipment shown such as drilling derrick 400, drilling fluid pump 402, and mud tank/solids control equipment 406 are used in most conventional drilling operations. Other equipment for under balanced drilling, such as four-phase (oil, water, cuttings, and gas) separator 404, flare stack 405, oil storage tanks 409, produced water storage tanks 408, and drilling fluid storage tanks 407, are also shown. The additional surface equipment needed to operate the concentric jet pump is power fluid pump 401 and power fluid filtration equipment 403. A separate pump is needed to force power fluid 100 down the annulus. Drilling fluid pump 302 cannot be used for two reasons. First, power fluid pump 401 needs to operate at much higher pressures than drilling fluid pump 402. Second, power fluid 100 needs to be filtered so that it does not prematurely erode the nozzles in (DHDA 300. Drilling fluid 101 that is pumped and circulated down drill string 110 by drilling fluid pump 402 contains "drilling fines" that are generated from the rock being drilled, hence the name mud, and would not be suitable to pass through a small jet pump nozzle.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

What is claimed is:

1. A down hole drilling assembly comprising:

a jet pump assembly having a jet pump;

a drill bit attached to a drill pipe;

wherein the jet pump assembly remains stationary when the drill bit is moved; and wherein the drill pipe passes through the jet pump assembly and the jet pump assembly is located downhole.

2. The down hole drilling assembly of claim 1 further comprising a drilling fluid inlet housing affixed to an inner casing of a concentric casing string section.

3. The down hole drilling assembly of claim 1 further comprising a drilling fluid inlet; and wherein a drilling fluid flows into the jet pump assembly through the drilling fluid inlet.

4. The down hole drilling assembly of claim 1 further comprising a drilling fluid chamber.

5. The down hole drilling assembly of claim 1 further comprising a bladder housing.

6. The down hale drilling assembly of claim 1 further comprising a pump housing.

7. The down hole drilling assembly of claim 1 further comprising a bladder; wherein the bladder extends from the jet pump assembly to the drill pipe.

8. The down hole drilling assembly of claim 1 further comprising a packer; wherein the packer separates a power fluid from, a drilling fluid.

9. The down hole drilling assembly of claim 1 further comprising a power fluid.

10. The down hole drilling assembly of claim 1 wherein the jet pump assembly is a fixed to a casing pipe and the casing string is separate from the drill string.

11. The down hole drilling assembly of claim 1 wherein the jet pump assembly remains in a well bore when the drill bit and the drill pipe are removed from the well bore.

12. An apparatus comprising:

a concentric casing string section having an inner siring section and an outer string section;

a jet pump assembly affixed to the inner string section;

a jet pump affixed to the jet pump assembly;

a drill string section passing through the jet pump assembly;

a drill bit affixed to the drill string section;

wherein a power fluid passes through the jet pump imparting momentum to a drilling fluid and production fluid so the hydrostatic pressure exerted by a column of fluid contained within a well bore is reduced; and wherein the drill bit operates independently of the jet pump assembly and the jet pump assembly is located downhole.

13. The apparatus of claim 12 further comprising a packer element affixed to the jet pump assembly.

14. The apparatus described in claim 12 further comprising a bladder affixed to the jet pump assembly, wherein the bladder inflates from a first position to a second position in contact with the drill string section thereby directing the flow of the drilling fluid into the jet pump assembly.

15. The apparatus described in claim 12 further comprising a bladder inflation assembly, wherein the bladder inflation assembly uses a high pressure fluid to inflate a bladder.

16. The apparatus described in claim 12 wherein the power fluid is water.

17. The apparatus described in claim 12 wherein the jet pump further comprises:

a nozzle adapted for threaded engagement with the jet pump so that said nozzle may be removed and replaced by another nozzle; and a diffuser adapted for threaded engagement with the jet pump so that said diffuser may be removed and replaced by another diffuser.

18. The apparatus of claim 12 further comprising a bladder wherein the bladder extends from the jet pump assembly to the drill section when inflated.

19. The apparatus of claim 12 wherein the jet pump assembly remains stationary when the drill string section is moved.

20. An apparatus consisting of:

a jet pump having a nozzle, a throat, and a diffuser;

a concentric casing string having an inner easing section and an outer casing section;

a bladder affixed to the jet pump, wherein the bladder directs the flow of drilling fluid into the jet pump;

a drill string passing through the jet pump;

a drill bit connected to the drill string;

a power fluid;

a drilling fluid;

wherein the jet pump is affixed to the inner casing section;

wherein the power fluid and drilling fluid do not mix until after the power fluid passes through the nozzle; and wherein the jet pump utilizes the power fluid to induce lift in the drilling fluid.

21. The apparatus of claim 20 further comprising a bladder inflation assembly affixed to the jet pump, wherein the bladder inflation assembly uses the high pressure fluid to inflate the bladder.

22. The apparatus of claim 20 wherein the power fluid is selected from a group consisting of water, oil, and diesel.

23. The apparatus of claim 20 wherein:

the nozzle is adapted for threaded engagement with the jet pump so that the nozzle may be removed and replaced by another nozzle; and the diffuser is adapted for threaded engagement with the jet pump so that the diffuser may be removed and replaced by another diffuser.

24. The apparatus of claim 20 wherein the bladder extends from the jet pump to the drill string when inflated.

25. The apparatus of claim 20 wherein the jet pump assembly remains stationary when the drill string is moved.

26. An apparatus consisting of:

a jet pump having a nozzle, a throat, and a diffuser, a plurality of concentric casings sections, each of said concentric casing sections consisting of an inner casing section and an outer casing section, wherein the jet pump is fixedly joined to the inner casing section;

a bladder affixed to the jet pump, wherein the bladder directs the flow of a drilling fluid into the apparatus;

a bladder inflation assembly, wherein the bladder inflation assembly uses a power fluid to inflate the bladder.

27. The apparatus of claim 26 wherein the power fluid is selected from a group consisting of water, oil, and diesel.

28. The apparatus described in claim 26 wherein:

the nozzle is adapted for threaded engagement with the jet pump so that the nozzle may be removed and replaced by another nozzle; and the diffuser is adapted for threaded engagement with the jet pump so that the diffuser may be removed and replaced by another diffuser.

29. The apparatus of claim 26 wherein the bladder extends from the jet pump to the drill string when inflated.

30. The apparatus of claim 26 wherein the jet pump remains stationary when the drill string is moved.

31. A method of inducing lift in a drilling fluid consisting of:

utilizing a plurality of concentric casings including at least one inner casing section and one outer casing section;

attaching a jet pump to the inner casing section; and injecting a pressurized fluid into the drilling and production fluid using the jet pump passing a drill string throught the jet pump.

32. The method of claim 31 further comprising redirecting the flow of the drilling fluid into the jet pump.

33. The method of claim 31 further comprising inflating a bladder using the pressurized fluid.

34. The method of claim 31 wherein the injecting step further comprises decreasing pressure in the drilling fluid.

35. The method of claim 31 wherein the injecting step further comprises creating under-balanced drilling conditions within a well bore.

36. The method of claim 31 further comprising: inflating a bladder;

wherein the bladder extends from the jet pump to the drill string when inflated.

37. A system comprising:

a plurality of concentric casings, consisting of at least an outer casing section and an inner casing section;

a jet pump fixedly joined to the inner casing;

a drilling derrick, wherein the derrick can insert a drill pipe and a casing into a well bore and can rotate the drill pipe;

a drilling fluid pump, wherein the drilling fluid pump circulates a drilling fluid from the surface to tho bottom of the well bore and back to the surface; and a power fluid pump, wherein the power fluid pump pressurizes the high pressure fluid that is injected into and down the outer annulus, through the jet pump and into the drilling and production fluid returning to the surface.

38. The system of claim 37 wherein a bladder extends from the jet pump to a drill string when inflated.

39. The method of claim 31 wherein the jet pump remains stationary when the drill string is moved.

40. The system of claim 37 wherein the jet pump remains stationary when the drill pipe is moved.

41. A down hole drilling assembly comprising:

a jet pump assembly having a jet pump;

a drill bit attached to a drill pipe;

wherein the jet pump assembly remains stationary when the drill bit is moved; and wherein the jet pump assembly is located within a well bore.

42. The down hole drilling assembly of claim 41 further comprising a drilling fluid inlet housing affixed to an inner casing of a concentric casing string section.

43. The down hole drilling assembly of claim 41 further comprising a drilling fluid inlet; and wherein a drilling fluid flows into the jet pump assembly through the drilling fluid inlet.

44. The down hole drilling assembly of claim 41 further comprising a drilling fluid chamber.

45. The down hole drilling assembly of claim 41 further comprising a bladder housing.

46. The down hole drilling assembly of claim 41 further comprising a pump housing.

47. The down hole drilling assembly of claim 41 further comprising a bladder, wherein the bladder extends from the jet pump assembly to the drill pipe.

48. The down hole drilling assembly of claim 41 further comprising a packer; wherein the packer separates a power fluid from a drilling fluid.

49. The down hole drilling assembly of claim 41 further comprising a power fluid.

* * * * *

UNITED STATES PATENT AND TRADEMARK OFFICE

CERTIFICATE OF CORRECTION

PATENT NO. : 6,877,571 B2
DATED : May 23, 2005
INVENTOR(S) : Hughes et al.

It is certified that error appears in the above-identified patent and that said Letters Patent is hereby corrected as shown below:

Column 6,
Line 52, “hale” should be -- hole --
Line 59, delete “,” after “from”
Line 63, “a fixed” should be -- affixed --
Line 63, “pipe” should be -- string --
Line 64, “string” should be -- pipe --

Column 7,
Line 2, “siring” should be -- string --
Line 37, insert -- ; -- after “bladder”
Line 38, “drill section” should be -- drill string section --
Line 44, “easing” should be -- casing --

Column 8
Line 17, “bladder.” should be -- bladder; and a drill string passing through the jet pump. --
Line 38, delete “and” after “;”
Line 40, insert -- ; and -- after “pump”
Line 41, “thought” should be -- through --
Line 64, “tho” should be -- the --

Signed and Sealed this

Twelfth Day of July, 2005

JON W. DUDAS
*Director of the United States Patent and Trademark Office*